US009750310B2

(12) United States Patent
Kolasa et al.

(10) Patent No.: US 9,750,310 B2
(45) Date of Patent: Sep. 5, 2017

(54) RELEASABLE BUCKLE

(71) Applicant: ILLINOIS TOOL WORKS INC., Glenview, IL (US)

(72) Inventors: Scott D. Kolasa, Mount Prospect, IL (US); Steven C. Keller, Island Lake, IL (US)

(73) Assignee: Illinois Tool Works Inc., Glenview, IL (US)

( * ) Notice: Subject to any disclaimer, the term of this patent is extended or adjusted under 35 U.S.C. 154(b) by 372 days.

(21) Appl. No.: 14/427,313

(22) PCT Filed: Sep. 13, 2013

(86) PCT No.: PCT/US2013/059615

§ 371 (c)(1),
(2) Date: Mar. 11, 2015

(87) PCT Pub. No.: WO2014/046973

PCT Pub. Date: Mar. 27, 2014

(65) Prior Publication Data

US 2015/0237972 A1 Aug. 27, 2015

Related U.S. Application Data

(60) Provisional application No. 61/702,570, filed on Sep. 18, 2012.

(51) Int. Cl.

| | |
|---|---|
| ***A44B 11/26*** | (2006.01) |
| ***A44B 11/00*** | (2006.01) |
| ***A42B 3/08*** | (2006.01) |

(52) U.S. Cl.

CPC ..... *A44B 11/266* (2013.01); *A42B 3/08* (2013.01); *A44B 11/006* (2013.01); *A44B 11/26* (2013.01);

(Continued)

(58) Field of Classification Search

CPC ... A44B 11/2549; A44B 11/26; A44B 11/266; Y10T 24/45529; Y10T 24/45524;

(Continued)

(56) References Cited

U.S. PATENT DOCUMENTS 1,136,107 A * 4/1915 Croasdale ..... A41F 3/00 24/315
5,311,649 A * 5/1994 Suh ..... A44B 11/266 24/616

(Continued)

FOREIGN PATENT DOCUMENTS

CN 1103567 A 6/1995
CN 1723818 A 1/2006

(Continued)

OTHER PUBLICATIONS

ISR and WO for PCT/US2013/059615 dated Nov. 19, 2013.

*Primary Examiner* — Jack W Lavinder
(74) *Attorney, Agent, or Firm* — Joseph M. Butscher; The Small Patent Law Group, LLC

(57) ABSTRACT

A buckle having linear engagement and disengagement activation. The buckle includes a body having a hollow sleeve portion defining a through passage extending between a proximal opening and a distal opening. Lateral openings are disposed along opposing sides of the sleeve portion. A depressible button is held in reciprocating relation within the distal opening. A male latch member having a pair of legs is adapted to be inserted into the proximal opening for locking engagement of the legs behind tabs within the sleeve portion. The latch member is releasable upon depression of the button.

20 Claims, 8 Drawing Sheets

(52) U.S. Cl.
CPC ..... *Y10T 24/4086* (2015.01); *Y10T 24/45482* (2015.01)

(58) Field of Classification Search
CPC ..... Y10T 24/45775; Y10T 24/4736; Y10T 24/45534; Y10T 24/45539; A42B 3/08
See application file for complete search history.

(56) References Cited

U.S. PATENT DOCUMENTS

| | | | | |
|---|---|---|---|---|
| 5,465,472 | A | 11/1995 | Matoba | |
| 6,052,875 | A | 4/2000 | Fudaki | |
| 6,363,590 | B1 * | 4/2002 | Lan | A44B 11/26 24/614 |
| 6,796,007 | B1 | 9/2004 | Anscher | |
| 9,629,410 | B2 * | 4/2017 | Perreault | A42B 3/08 |
| 2005/0132545 | A1 * | 6/2005 | Anscher | A44B 11/2549 24/615 |
| 2006/0016050 | A1 | 1/2006 | Yoshiguchi | |
| 2007/0017074 | A1 | 1/2007 | Pontaoe | |

FOREIGN PATENT DOCUMENTS

| | | | |
|---|---|---|---|
| CN | 1899148 | A | 1/2007 |
| CN | 102341010 | A | 2/2012 |
| JP | 2001061513 | A | 3/2001 |

* cited by examiner

*FIG. –1–*

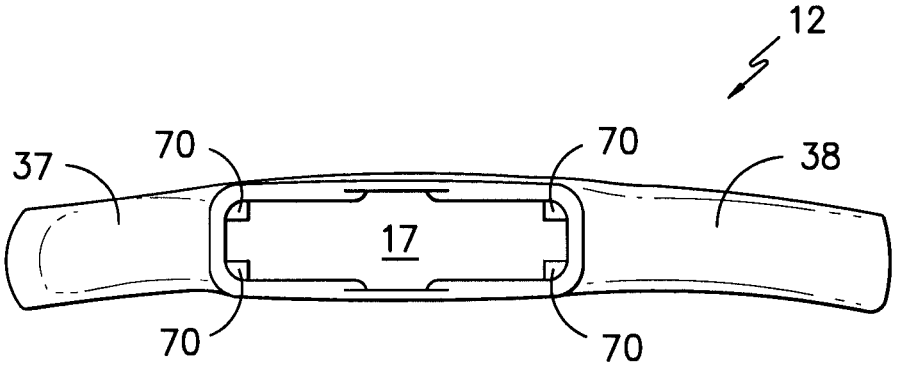
FIG. –4–
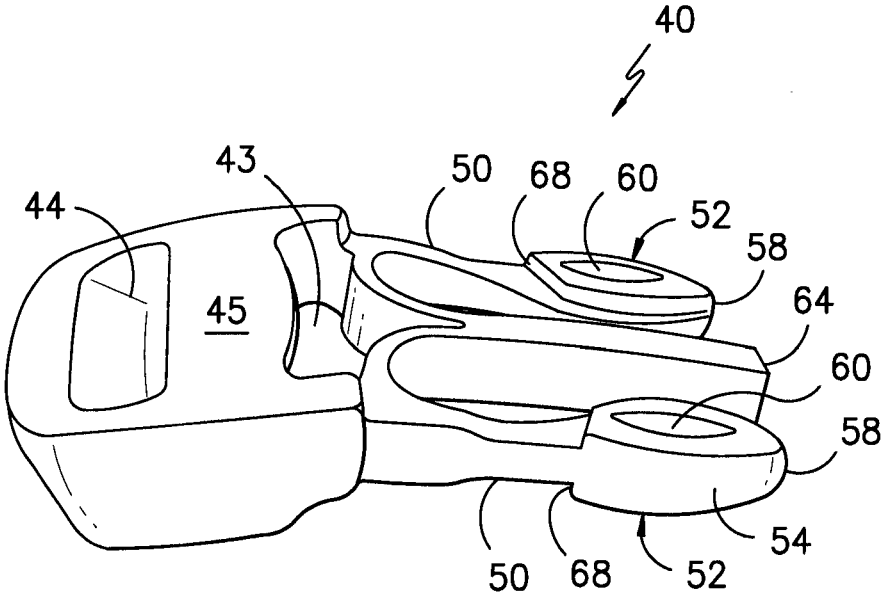
FIG. –5–

*FIG. –8–*

RELEASABLE BUCKLE

CROSS-REFERENCE TO RELATED APPLICATIONS

This application is a National Phase of International Application Number PCT/US2013/059615 filed Sep. 13, 2013 and claims the benefit of, and priority from, United States provisional application 61/702,570 filed Sep. 18, 2012, the contents of which are hereby incorporated by reference as if fully set forth herein.

TECHNICAL FIELD

This disclosure relates to buckles, and more particularly, to a releasable buckle which may be used in environments such as helmets, backpacks and the like. The buckle is adapted for one-handed latching and release to promote ease of use.

BACKGROUND

Two-piece buckles that snap together and latch automatically upon adequately inserting a male component into a female component are known and are used in a variety of applications. A piece of webbing can be attached to one or both of the buckle components, and one or both buckle components can be adjustably retained on the webbing. It is also known to have both components in fixed locations relative to a strap or web that is sewn or otherwise fixedly secured to the buckle component. Such buckles are known and used for a variety of applications, including outdoor recreational products such as backpacks, bike helmets, life vests and other equipment. Two-part buckles are used also on luggage, bags, clothing and the like.

In one known design for buckles of this type, the female component defines a receiving body and includes openings or windows on the lateral, opposed sides of the receiving body. The male component includes arms having outward protrusions slightly wider than the width of the female component at some positions from the entrance to the window. As the male component is inserted into the female component, the arms are deflected inwardly and thereafter are allowed to rebound outwardly when the protrusions align with the windows in the female component. With the protrusion extending slightly outwardly at the window, the male component is secured within the female component. For added security, additional confronting surfaces on the male and female components engage one against another as the male component reaches a final, locked position. The locked relation is released by squeezing the protrusions inwardly from the window, and pulling the male member outwardly.

While buckles of the type described have had success in many applications, they are not without deficiencies. For example, to improve resistance to unintended release of the buckle when the buckle is placed under load, bulky, thick components have been used. Some buckles are difficult to release when under load. While such buckles may release easily when not under load, if the engaging surfaces are directed angularly forward, release requires movement of the male lock arms such that the male member is actually driven deeper into the female component as engaging surfaces slide beyond each other. When under load, this causes an increase in the load, and as a result, the release mechanism can be difficult to operate. Moreover, the disengagement using two fingers to compress the prongs of the latch together may be difficult for some users to manage. This may be particularly true for small children and persons with limited finger mobility. Further, in manufacturing prior buckles, large tolerances have been used. Accordingly, when latched but not under load, the male and female components may feel loosely fit one in the other and may even rattle or otherwise move. While such looseness may not affect overall performance of the buckle, the user may feel that the buckle is not secure. The user may adjust the adjustable strap to make the strap exceedingly taut so that rattle is eliminated and the buckle is under continuous load. This, then, can result in the aforementioned difficulty in releasing the buckle under load.

Accordingly, there is a continuing need for a simplified buckle providing enhanced ease of manipulation.

SUMMARY OF THE DISCLOSURE

According to one feature, the present disclosure provides advantages and alternatives over the prior art by providing a buckle having a linear engagement and disengagement activation with a single release point. A buckle of the present disclosure thus significantly promotes ease of use. The buckle is also readily adapted for use in spaces where lack of finger access may be problematic.

In accordance with one exemplary aspect, the present disclosure provides a releasable buckle adapted to engage at least a first strap element. The buckle includes a body of unitary molded construction including a hollow sleeve portion defining a through passage extending between a proximal slot opening and a distal slot opening. Lateral openings are disposed along opposing lateral the sides of the sleeve portion. The sleeve portion includes at least one pair of locking tabs in the form of raised profile detents disposed at the interior of the sleeve portion at an elevation below the lateral openings. The locking tabs have inboard edges cooperatively defining a constriction within the sleeve portion. A depressible button of unitary molded construction is held in reciprocating relation within the distal slot opening. The depressible button includes a button base and a pair of fingers projecting away from the button base. An optional extended button detent may project away from the button base at a position between the fingers. A male latch member of unitary molded construction is adapted to be inserted into the proximal slot opening. The latch member includes a pair of legs projecting away from a latch base and an elongated post mounted between the legs. The legs may each include an elongated resilient spring segment operatively connected to an enhanced diameter distal head. The legs are adapted to flex inwardly during insertion of the latch member into the sleeve portion and the distal heads are adapted to extend at least partially through the lateral openings and to snap in locking relation behind the locking tabs when the distal heads are pushed past the locking tabs. Upon forced depression of the button, the fingers urge the distal heads radially inwardly from the locking tabs and the latch is forced out of the body.

Other objects and advantages of the carrying device will become apparent from a description of certain preferred embodiments thereof which are described and shown in the drawings.

BRIEF DESCRIPTION OF THE DRAWINGS

FIG. 4 is a schematic end view of the female body portion of the side release buckle of FIG. 2 taken generally along line 4-4 in FIG. 2;

FIG. 5 is a schematic side view of a male latch element of the side release buckle of FIG. 2 taken generally along line 5-5 in FIG. 2;

Figure 1:
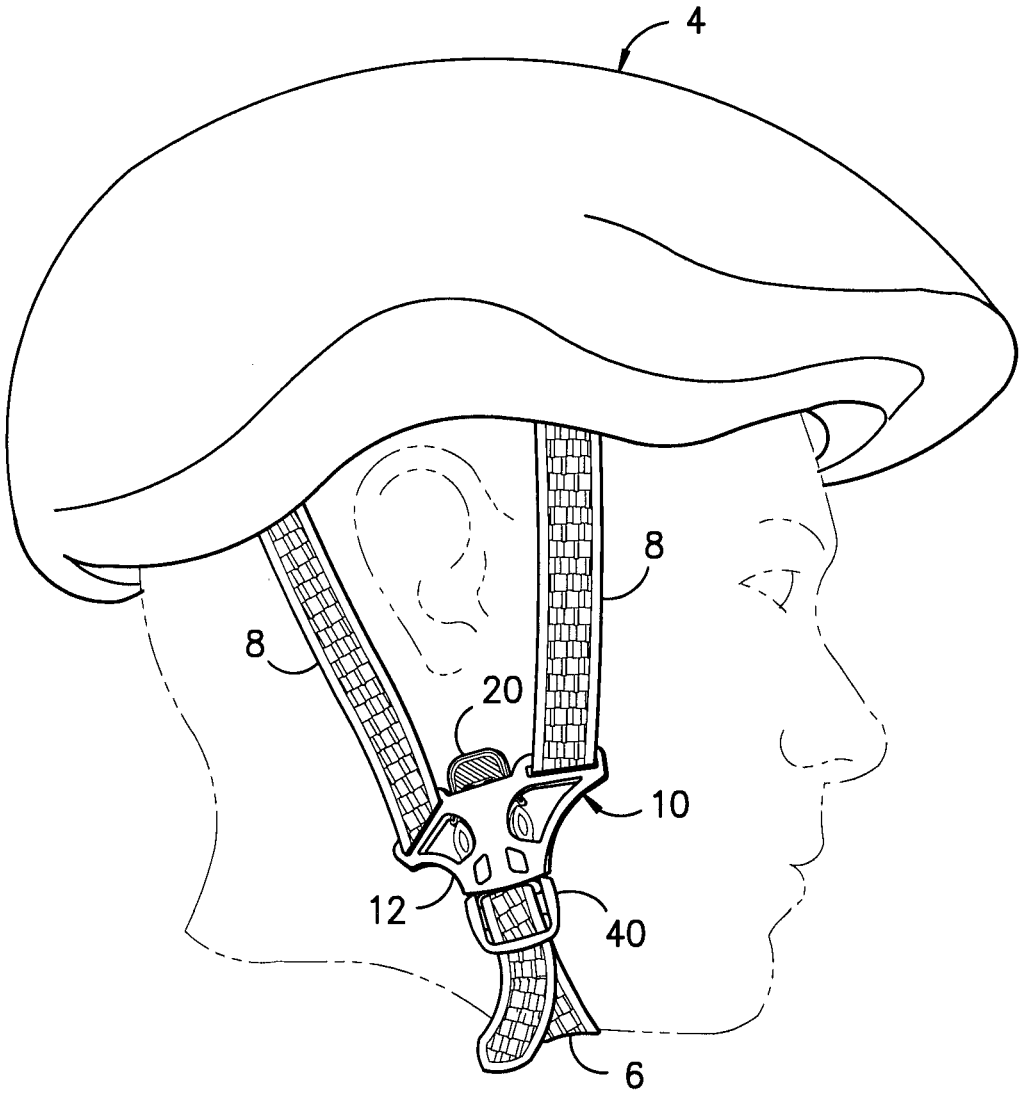
FIG. 1 is a schematic view of an exemplary bicycle helmet with a chin strap engaging a side release buckle consistent with the present disclosure.

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION OF PREFERRED EMBODIMENTS

Reference will now be made to the drawings, wherein to the extent possible, like elements are designated by like reference numerals in the various views. FIG. 1 is a schematic view of an exemplary bicycle helmet 4 with a chin strap 6 and a pair of helmet connection straps 8 engaging a releasable buckle 10 consistent with the present disclosure. In operation, the chin strap 6 may be threaded in adjustable cinching relation through a pair of eyelets at the bottom of the buckle 10 in a manner as will be well known to those of skill in the art, while each of the helmet connection straps 8 may be held in fixed relation to a defined eyelet at the top of the buckle 10. Thus, by adjusting the chin strap 6, the helmet may be tightened or loosened as desired. Of course, it is also contemplated that each of the helmet connection straps 8 may likewise be adjustable if desired. It is likewise contemplated that the buckle 10 may be used in any number of environments other than helmets. By way of example only, and not limitation, such other environments of use may include connections for backpacks, life vests, luggage, bags, clothing and the like.

As best seen through joint reference to FIGS. 2-5, the illustrated exemplary buckle 10 includes a body 12 of generally hollow molded construction including connection eyelets 14 for attachment of straps, webbing or the like (not shown). As seen through reference to FIG. 4, the body 12 may be slightly bowed from side to side so as to conform more readily to an underlying curved surface. By way of example only, such a bowed configuration may be useful when the buckle is used to hold helmet straps in place relative to a chin strap. As will be appreciated, in such an environment of use, the bowed construction may aid in conforming to a user's jaw line while maintaining a low profile. In accordance with one exemplary practice, the body 12 may have a unitary molded construction formed from suitable polymeric materials by injection molding or the like. By way of example only, exemplary materials of construction for the body may include Nylon 6,6, acetal resin, polyester resin and the like.

In the illustrated exemplary construction, the body 12 includes a hollow axial sleeve portion 16 of generally hourglass shape defining a through channel extending through a narrowed throat between a proximal slot opening 17 and a distal slot opening 18. In the illustrated exemplary construction, the connection eyelets 14 and the distal slot opening 18 are arranged in substantially end to end relation in a dogleg pattern extending along the upper perimeter of the body 12.

As shown, an insertable button 20 is adapted for insertion into the distal slot opening 18. In the illustrated exemplary construction, the button 20 includes a pair of diverging fingers 24 projecting away from the lower edge of a base 26. As shown, the base 26 of the button 20 may have convex curved lateral sides 28. In the illustrated construction, an optional button detent 30 projects away from the lower edge at a position between the fingers 24. As will be described more fully hereinafter, the fingers act to engage an opposing latch element so as to force the latch element out of the axial sleeve portion 16 when the button 20 is fully depressed.

Figure 2:
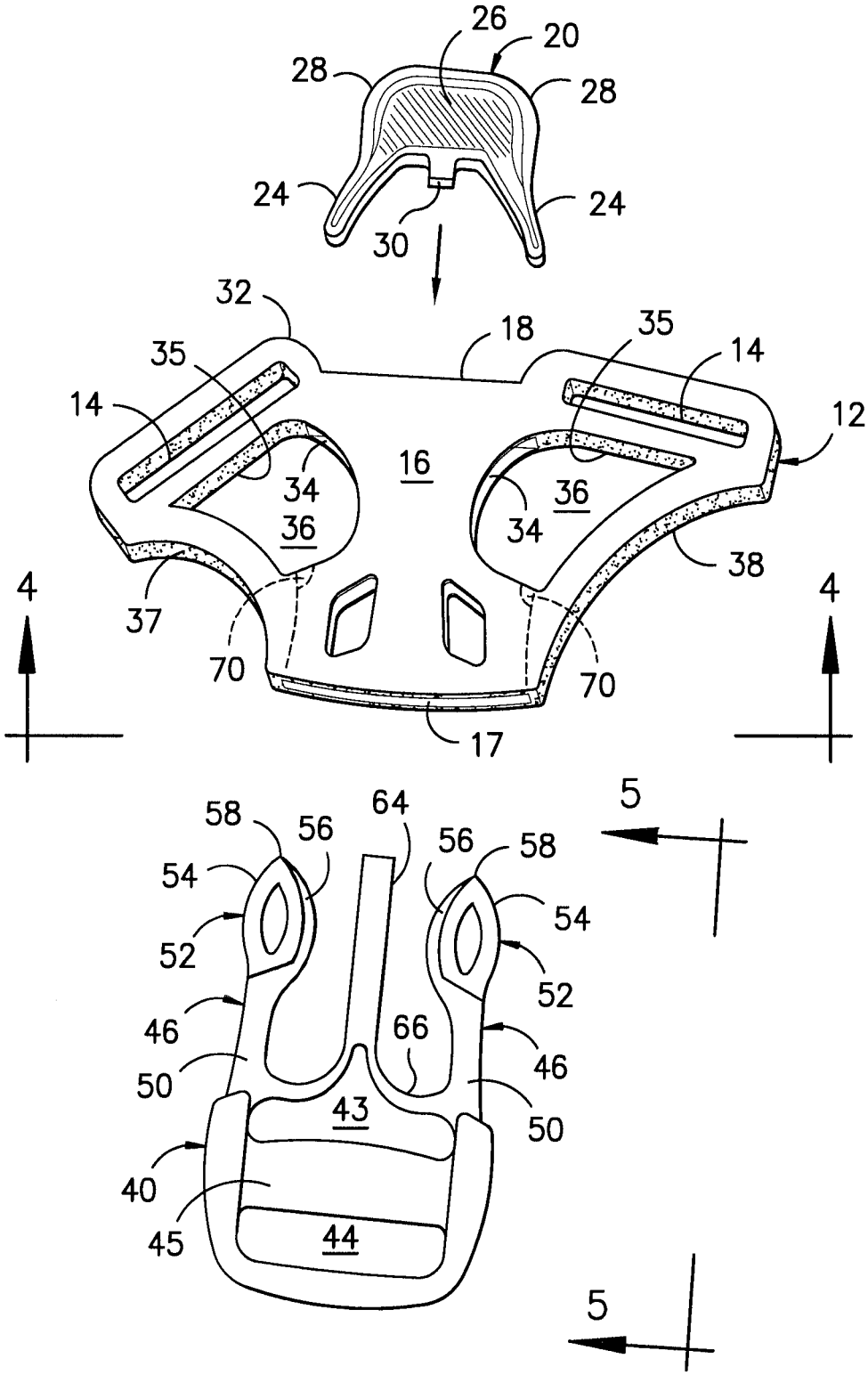
FIG. 2 is an exploded assembly view illustrating the components of an exemplary side buckle consistent with the present disclosure.
Figure 3:
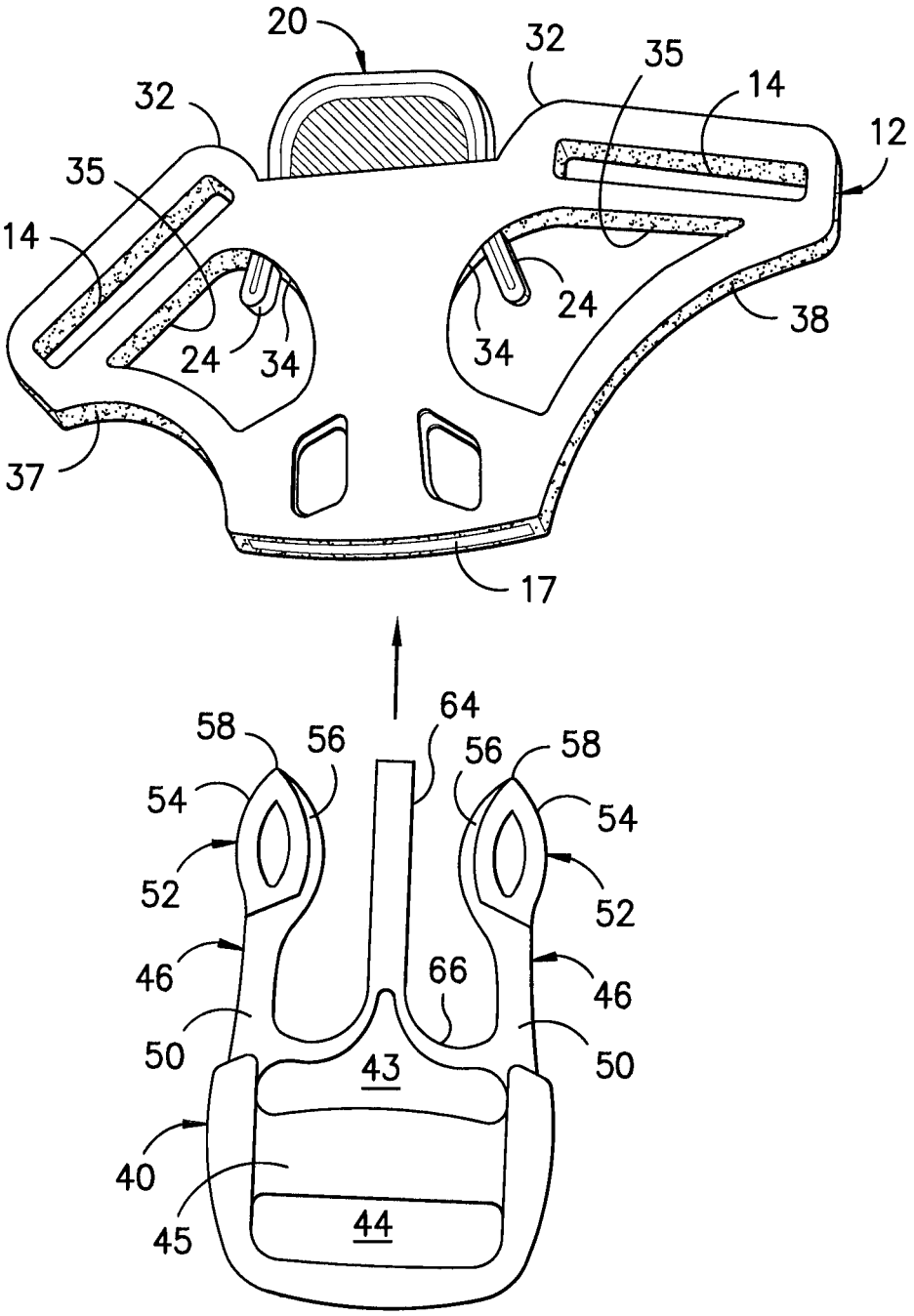
FIG. 3 is an intermediate assembly view of the side release buckle of FIG. 2 illustrating a latch arranged for insertion into a body with a depressible release button in place.
Figure 6:
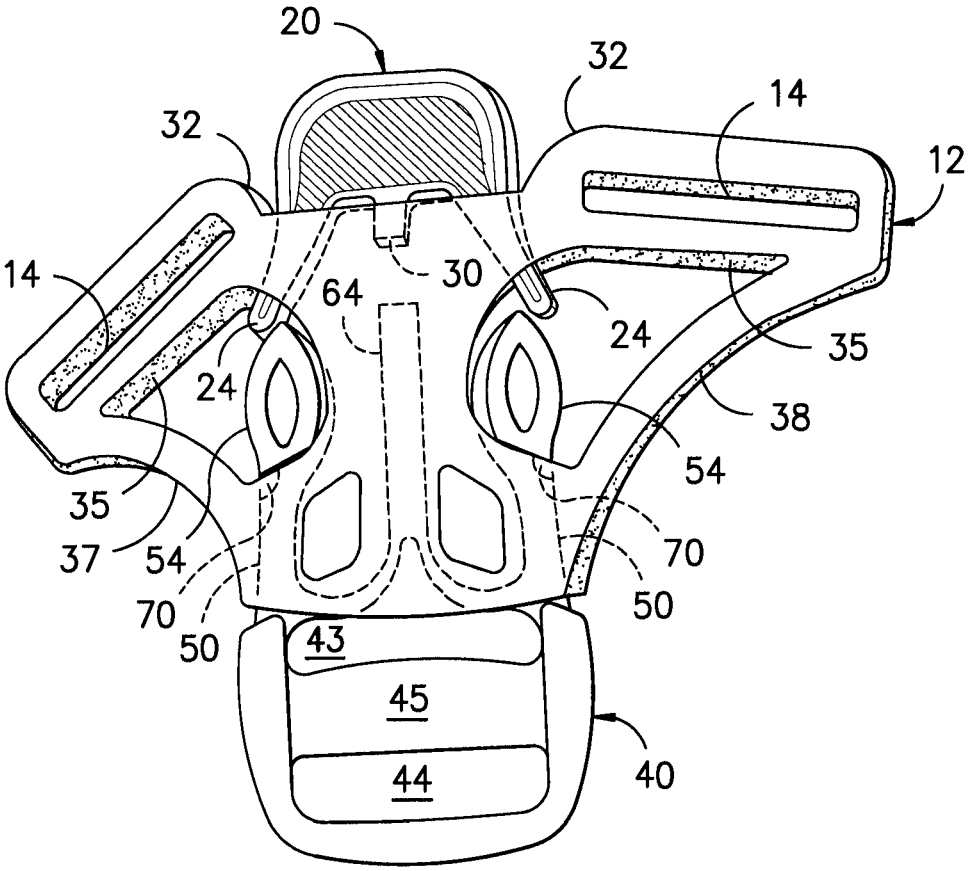
FIG. 6 is a view illustrating the fully assembled side release buckle of FIG. 2 with the latch locked in place within the body.

As best seen through joint reference to FIGS. 2, 3 and 6, in one exemplary embodiment when the button 20 is inserted into the distal slot opening 18 during assembly, the free ends of the fingers 24 may initially contact rounded shoulders 32 on either side of the distal slot opening 18. As shown, the rounded shoulders slope radially inwardly in a converging manner towards opposing ends of the distal slot opening 18. When the button 20 is pressed inwardly from the position shown in FIG. 2 to the position shown in FIG. 3, the fingers 24 will be urged radially inwardly by the rounded shoulders in a camming action. As insertion of the button is completed (FIG. 3), the fingers 24 may then spring outwardly through lateral openings 34 at the concave scalloped sides of a reduced diameter throat segment of the sleeve portion 16. Alternatively, in the event that the fingers 24 are substantially inflexible, the distal slot opening 18 may be sized to accept the button 20 in a friction fit arrangement with the material of the body 12 being sufficiently resilient to permit the distal slot opening 18 to expand slightly as the button 20 is inserted and to then conform around the button 20 to block withdrawal in the absence of substantial applied force.

Regardless of the insertion technique, once the button 20 is inserted it may be pressed inwardly, but is blocked from being retracted outwardly from the distal slot opening 18 in the absence of substantial applied extraction force. In this regard, in the illustrated exemplary construction, blocking action is provided by the solid wall segments 35 positioned outboard of the lateral openings 34. As will be appreciated, when an extraction force is applied to the button 20, the solid wall segments 35 will act to block withdrawal of the button unless sufficient extraction force is applied. This extraction force is sufficiently great to avoid unintended removal of the button 20. However, upon the application of adequate extraction force, the button may be extracted if necessary.

As illustrated, the free ends of the fingers 24 may project radially outwardly beyond the lateral sides 28 of the base 26. Moreover, the width and thickness of the base 26 may be sized such that once the initial insertion of the button 20 has taken place, the base 26 (but not the fingers) may be moved in and out of the distal slot opening 18 as axial force is applied. In accordance with one exemplary practice, the internal thickness dimension of the distal slot opening 18 may be sized to substantially match the external thickness dimension of the base 26 such that the base 26 will be held within the distal slot opening 18 in a friction fit, but will move easily as force is applied.

In the illustrated exemplary construction, the body 12 includes a pair of enclosed window openings 36 disposed on either side of the sleeve portion 16 outboard from the lateral openings 34. A pair of curved sidewalls 37, 38 are disposed radially outboard from the window openings 36. As shown, in the illustrated construction, the curved sidewalls 37, 38 each include a concave outer surface extending between the proximal slot opening 17 and an adjacent connection eyelet 14 on either side of the body 12. The concave outer surfaces of the sidewalls 37, 38 define finger tabs for application of pressure by a user as the button 20 is being depressed. By way of example only, a user may use an index finger and middle finger to apply upward pressure against the concave outer surfaces of the sidewalls 37, 38 while using the thumb of the same hand to apply downward pressure against the button 20 as it is pressed into the sleeve portion 16. As will be appreciated, by the application of opposing forces, a substantial mechanical advantage may be realized, thereby facilitating the ability to depress the button 20 despite using only one hand. The ability to depress the button 20 using one hand may be beneficial when the buckle is released during use.

As shown, in the exemplary construction the buckle 10 further includes a latch 40 adapted to be inserted in matable relation into the sleeve portion 16 of the body through proximal slot opening 17. In accordance with one exemplary practice, the latch 40 may have a unitary molded construction formed from a suitable polymeric material by injection molding or the like. By way of example only, exemplary materials of construction for the latch may include Nylon 6,6, acetal resin, polyester resin and the like. The materials forming the body 12 and the latch 40 may be either the same or may be different.

In the illustrated exemplary construction, the latch 40 includes a latch base including a pair of eyelets 43, 44 separated by a crossbar 45 for acceptance of a strap, webbing or other element in adjustable cinching relation in a manner as will be well known to those of skill in the art. A pair of resiliently flexible legs 46 extends upwardly away from the latch base. As shown, each of the legs includes an elongated spring segment 50 and an enhanced diameter distal head 52. In the illustrated exemplary construction, each of the distal heads 52 is substantially elliptical with outboard convex curved sides 54 and inboard convex curved sides 56. The outboard convex curved sides 54 and inboard convex curved sides 56 converge at a tip 58. As shown, cavities 60 may extend through the thickness dimension of the distal heads 52 such that the distal heads have an annular construction. However, the cavities 60 may likewise be eliminated if desired. As best seen in FIG. 5, the distal heads 52 of the legs 46 may have a thickness dimension which is greater than the thickness dimension of the elongated spring segments 50. Accordingly, raised shoulders 68 are disposed at the base of the distal heads 52.

In the illustrated exemplary construction, an elongated post 64 may extend away from the latch base between the legs 46. The free end of the post 64 may extend a distance slightly greater than the tips 58 of the legs 46. As shown, the post 64 may be integral with a resilient, substantially cusp-shaped cross-support 66 extending in spanning relation between the elongated spring segments 50 of the legs 46. As shown, in the exemplary construction, the post 64 may be disposed substantially in alignment with the apex of the cusp formed by the cross-support 66.

Figure 7:
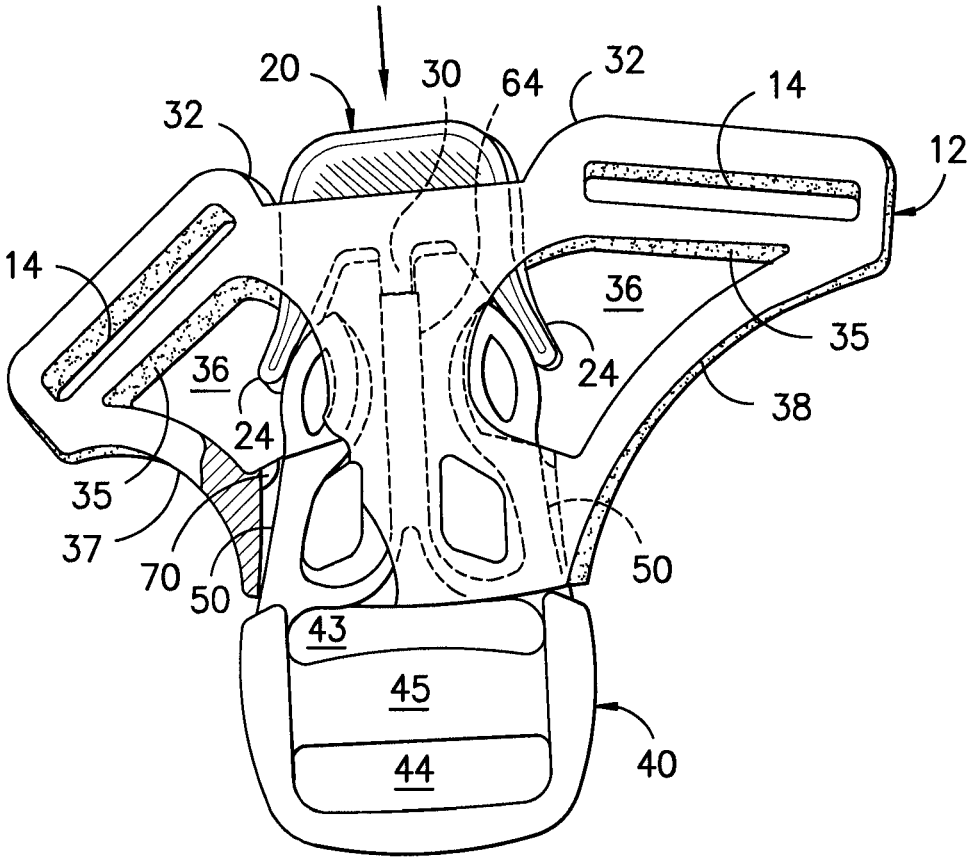
FIG. 7 is a partial cut-away view illustrating the initial stage of forced expulsion of the latch from the body by depression of the release button.

As best seen through joint reference to FIGS. 3 6, and 7, in the illustrated exemplary construction, when the latch 40 is inserted into the proximal slot opening 17 (towards the inserted button 20), the outboard curved sides 54 of the distal heads 52 will encounter a pair of locking tabs 70 in the form of detents extending partially across the thickness dimension of the sleeve portion adjacent to opposing lateral sides of the through channel. As shown, the locking tabs 70 are disposed at an elevation below the windows 36. The locking tabs 70 preferably have a sloped or convex curved outer edge projecting towards the central axis of the sleeve portion 16 with a substantially planar upper edge disposed in opposing relation to the window 36. If desired, two locking tabs may be disposed on each side of the through channel and may project towards one another in the thickness dimension of the body (FIG. 4). However, a single locking tab 70 on each side also may be used. If two opposing locking tabs 70 are used, the distance between those tabs is preferably greater than the thickness dimension of the elongated spring segments 50 and slightly less than the thickness dimension of the distal heads 52.

As the curved sides 54 of the distal heads 52 are pushed past the curved or sloped outer edges of the locking tabs 70, the legs 46 will be caused to flex inwardly towards the central axis of the sleeve portion 16 and the post 64. In this regard, the outboard curved sides 54 of the distal heads 52 define camming surfaces to facilitate the desired inward flexion of the elongated spring segments 50 during insertion. As the distal heads 52 are pushed past the locking tabs 70, at least the outboard curved sides 54 of the distal heads 52 may pass through the lateral openings 34 at the sides of the sleeve portion 16 and the legs 46 will snap back to their normal unbiased orientation. In this condition, the shoulders 68 at the base of the distal heads 52 will be disposed behind the planar upper edges of the locking tabs 70 and will be blocked against withdrawal thereby forming a locking relation. Thus, the latch 40 is held in snap-in relation within the body 12.

Referring now jointly to FIGS. 3 and 6, it may be seen that when the latch 40 is fully inserted into the body 12, the distal heads 52 will contact the fingers 24 and will urge the button 20 outwardly to the final latched position as shown in FIG. 6. In the latched condition, the fingers 24 will corral the tips 58 of the distal heads 52 along the outboard curved sides 54. In this condition, the latch is blocked against withdrawal by locking engagement of the locking tabs 70. At the same time, outward movement of the button 20 is limited by blocking engagement between the fingers 24 and the solid wall segments 35. Accordingly, a secure relationship is established between the body 12, the button 20 and the latch 40. In this condition, substantial tensioning forces may be applied without resulting in component separation.

Figure 8:
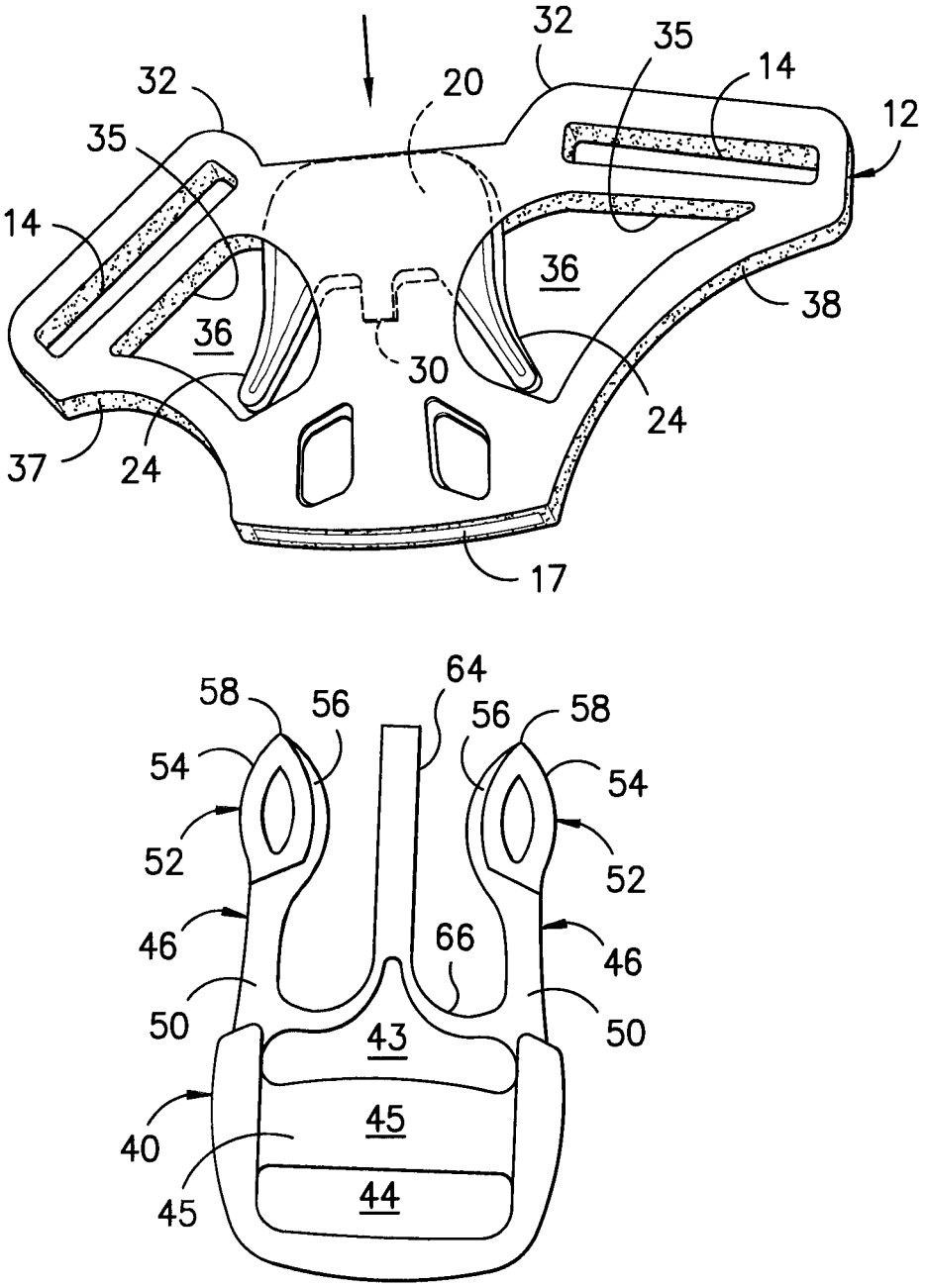
FIG. 8 is a view illustrating the initial stage of forced expulsion of the latch from the body by depression of the release button.

Referring now to FIGS. 6-8, in order to release the latch 40 from the body 12, the button 20 may be depressed in the direction of the latch (FIG. 7). As the button 20 is depressed, the fingers 24 urge the legs 46 downwardly and inwardly towards one another. As inward movement of the button 20 continues, the fingers 24 apply further inward pressure to the legs 46, until they are moved sufficiently inward to disengage from the locking tabs 70. The combined disengagement from the locking tabs 70 and the applied downward force thereby urges the latch 40 to be released from the body 12 (FIG. 8). Of course the latch 40 may thereafter be reattached by simply reversing the process and reinserting the legs 46 and post 64 into the proximal slot opening 17.

In the event that the button 20 includes the optional button detent 30 between the fingers 24, depression of the button 20 causes the button detent 30 to move from the position of FIG. 6 to the position of FIG. 7 such that it may engage and push against the end of the post 64. As will be appreciated, such engagement may provide additional axial force against the latch 40 to facilitate extraction if desired. Of course, withdrawal of the latch 40 may be urged solely by the fingers 24 (without the button detent 30) if desired.

In the illustrated exemplary construction, after the forced extraction of the latch 40, the button 20 will be in a depressed position (FIG. 8). In this regard, the thickness of the button 20 may be substantially matched to the internal height of the sleeve portion 16 such that in the depressed condition, the button 20 is clamped lightly by the interior surfaces of the sleeve portion 16. Thereafter, upon reinsertion of the latch 40, the post 64 will urge the button 20 back towards the position shown in FIG. 6. The movement back to this position is accelerated when the tips of the legs 46 snap into place through the lateral openings 34 in the sleeve portion 16 and urge against the fingers 24. As will be appreciated, with the legs 46 and the button 20 back in the condition of FIG. 6, a reversible, locked relationship is reestablished.

Figure 9:
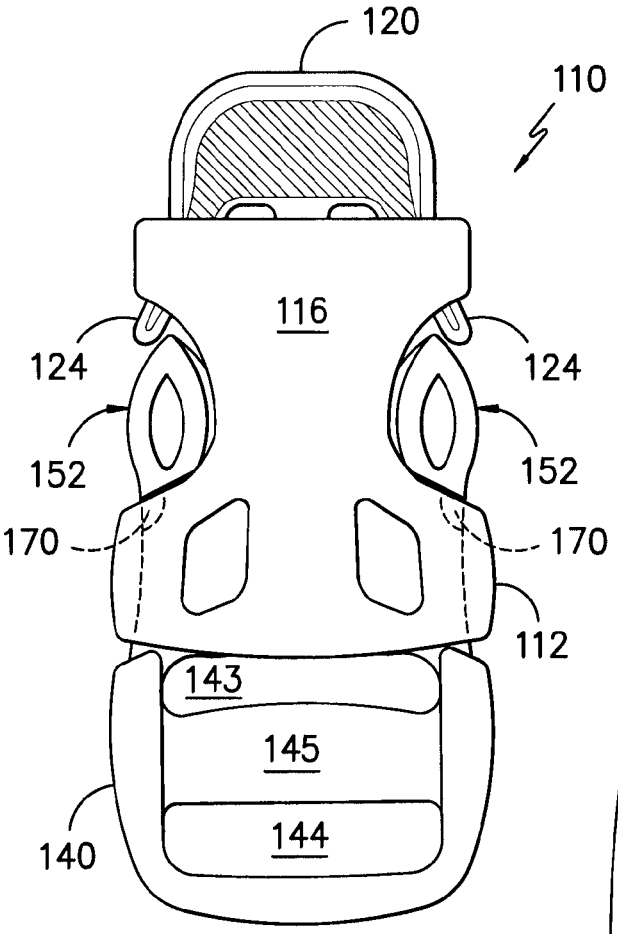
FIG. 9 illustrates an alternative embodiment of a buckle consistent with the present disclosure.

As will be appreciated, buckles consistent with the present disclosure are in no way limited to the particular shape of the body as shown in FIGS. 1-8. Rather any number of other shapes may be used. By way of example only, and not limitation, FIG. 9 illustrates one potential alternative construction wherein like elements to those previously described are designated by like reference numerals increased by 100. As shown, in the embodiment of FIG. 9, the buckle 110 has a body 112 which is made up substantially of the hollow sleeve portion 116 without exterior structures supporting eyelets. However, the latching mechanism of this embodiment operates in the same way as described with respect to FIGS. 1-8 above.

Figure 10:
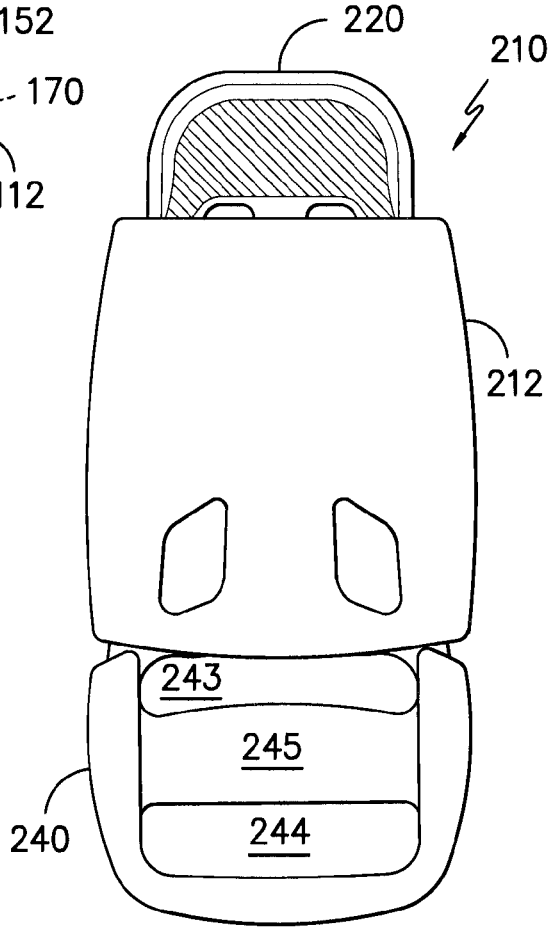
FIG. 10 illustrates another alternative embodiment of a buckle consistent with the present disclosure.

FIG. 10 illustrates yet another embodiment of a buckle consistent with the present disclosure wherein like elements to those previously described are designated by like reference numerals increased by 200. As shown, in the embodiment of FIG. 110, the body 212 is made up of an enclosed sleeve portion such that the tips of the legs are not visible. However, the latching mechanism of this embodiment operates in the same way as described with respect to FIGS. 1-8 above.

Of course, variations and modifications of the foregoing are within the scope of the present invention. Thus, it is to be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments and equivalents to the extent permitted by the prior art.

The invention claimed is:

1. A releasable buckle configured to engage at least a first strap element, the releasable buckle comprising:

a body including a hollow sleeve portion defining a through passage extending between a proximal slot opening and a distal slot opening, wherein lateral openings are disposed along opposing lateral sides of the sleeve portion, the sleeve portion including at least one pair of locking tabs cooperatively defining a constriction within the sleeve portion at an elevation below the lateral openings;

a depressible button held in reciprocating relation within the distal slot opening, the depressible button including a button base and a pair of fingers projecting away from the button base, wherein at least portions of the fingers extend through and out of the lateral openings; and a latch member configured to be matedly inserted into the proximal slot opening, the latch member including a pair of legs projecting away from a latch base, the legs each including an elongated resilient spring segment operatively connected to an enhanced diameter distal head, wherein the distal heads are configured to extend at least partially through and out of the lateral openings and to snap in locking relation behind the locking tabs when the distal heads are pushed past the locking tabs, and wherein upon forced depression of the button when the latch member is in place, the fingers are configured to urge the distal heads downwardly and radially inwardly out of locking relation behind the locking tabs.

2. A releasable buckle as recited in claim 1, wherein the body is bowed between lateral sides.

3. A releasable buckle as recited in claim 2, wherein the latch is bowed from end to end.

4. A releasable buckle as recited in claim 1, wherein the body is of unitary molded polymeric construction.

5. A releasable buckle as recited in claim 1, wherein the latch is of unitary molded polymeric construction.

6. A releasable buckle as recited in claim 1, wherein the body includes a pair of connection eyelets with one connection eyelet disposed adjacent either end of the distal slot opening.

7. A releasable buckle as recited in claim 6, wherein the connection eyelets are outwardly curved away from the distal slot opening along the upper perimeter of the body.

8. A releasable buckle as recited in claim 6, wherein enclosed window openings are disposed on either side of the sleeve portion outboard from the lateral openings, wherein the at least portions of the fingers are exposed through the enclosed window openings, and wherein at least portions of the distal heads are configured to also be exposed through the enclosed window openings along with the at least portions of the fingers.

9. A releasable buckle as recited in claim 8, wherein curved sidewalls are disposed radially outboard from the window openings to define outboard borders of the window openings, the curved sidewalls each including a concave outer surface defining a finger tab disposed between the proximal slot opening and an outboard end of a connection eyelet.

10. A releasable buckle as recited in claim 9, wherein the sleeve portion has a reduced diameter throat segment.

11. A releasable buckle as recited in claim 10, wherein an extended button detent projects away from the button base at a position between the fingers and an elongated post is mounted at a cusp-shaped cross-support extending between the legs, wherein the elongated post extends between the legs in alignment with the button detent, the elongated post having a length such that a free end of the post extends to a position beyond tips of the legs.

12. A releasable buckle configured to engage at least a first strap element, the releasable buckle comprising:

a body of unitary molded construction including a hollow sleeve portion defining a through passage extending between a proximal slot opening and a distal slot opening, wherein lateral openings are disposed along opposing lateral the sides of the sleeve portion, the sleeve portion including at least one pair of locking tabs comprising raised profile detents disposed at the interior of the sleeve portion at an elevation below the lateral openings, the locking tabs having inboard edges cooperatively defining a constriction within the sleeve portion;

a depressible button of unitary molded construction held in reciprocating relation within the distal slot opening, the depressible button including a button base and a pair of fingers projecting in diverging angled relation away from the button base, wherein at least portions of the fingers extend through and out of the lateral openings, and an extended button detent projecting away from the button base at a position between the fingers; and a male latch member of unitary molded construction configured to be inserted into the proximal slot opening, the latch member including a pair of legs projecting away from a latch base and an elongated post mounted between the legs, wherein the elongated post extends in substantially parallel relation to the legs and has a length such that a free end of the post extends to a position beyond tips of the legs, the legs each including an elongated resilient spring segment operatively connected to an enhanced diameter distal head and wherein a raised shoulder is disposed between the spring segment and the distal head, wherein the legs are configured to flex inwardly during insertion of the latch member into the sleeve portion, wherein the distal heads are configured to extend at least partially through the lateral openings and to snap in locking relation behind the locking tabs when the distal heads are pushed past the locking tabs, and wherein the button detent and the elongated post are oriented for disposition in substantial alignment within the sleeve portion such that upon forced depression of the button, the fingers are configured to urge the distal heads radially inwardly and the button detent is configured to apply a pushing force against the post such that the latch is forced out of the body.

13. A releasable buckle as recited in claim 12, wherein the body is bowed between lateral sides.

14. A releasable buckle as recited in claim 13, wherein the latch is bowed from end to end.

15. A releasable buckle as recited in claim 14 wherein the body includes a pair of connection eyelets with one connection eyelet disposed adjacent either end of the distal slot opening.

16. A releasable buckle as recited in claim 15, wherein the connection eyelets are outwardly curved away from the distal slot opening along the upper perimeter of the body.

17. A releasable buckle as recited in claim 15, wherein enclosed window openings are disposed on either side of the sleeve portion outboard from the lateral openings, wherein the at least portions of the fingers are exposed through the enclosed window openings, and wherein at least portions of the distal heads are configured to also be exposed through the enclosed window openings along with the at least portions of the fingers.

18. A releasable buckle as recited in claim 17, wherein curved sidewalls are disposed radially outboard from the window openings to define outboard borders of the window openings, the curved sidewalls each including a concave outer surface defining a finger tab disposed between the proximal slot opening and an outboard end of a connection eyelet.

19. A releasable buckle as recited in claim 18, wherein the sleeve portion has a reduced diameter throat segment disposed intermediate the proximal slot opening and the distal slot opening.

20. A releasable buckle adapted to engage at least a first strap element, the releasable buckle comprising:

a female body of unitary molded construction including a hollow sleeve portion defining a through passage extending between a proximal slot opening and a distal slot opening, wherein the sleeve portion has a reduced diameter throat segment disposed intermediate the proximal slot opening and a distal slot opening, wherein lateral openings are disposed along opposing lateral concave sides of the sleeve portion, the sleeve portion including at least one pair of locking tabs comprising raised profile detents disposed at the interior of the sleeve portion at an elevation below the lateral openings, the locking tabs having inboard edges cooperatively defining a constriction within the sleeve portion;

a depressible button of unitary molded construction held in reciprocating relation within the distal slot opening, the depressible button including a button base having convex curved lateral sides, the depressible button further including a pair of fingers projecting in diverging angled relation away from the button base, wherein at least portions of the fingers extend through and out of the lateral openings, and an extended button detent projecting away from the button base at a position between the fingers generally aligned with an axis of symmetry of the button base; and a male latch member of unitary molded construction adapted to be inserted into the proximal slot opening, the latch member including a latch base adapted to engage the first strap element in cinching relation, the latch member further including a pair of legs projecting away from the latch base and an elongated post mounted at a cross-support extending between the legs, wherein the elongated post extends between the legs in substantially parallel relation to the legs, the elongated post having a length such that a free end of the post extends to a position beyond tips of the legs, wherein the legs each include an elongated resilient spring segment and an enhanced diameter distal head, wherein a raised shoulder is disposed between the spring segment and the distal head, wherein the legs are configured to flex inwardly during insertion of the distal heads into the sleeve portion as outboard surfaces of the distal heads travel in camming relation over inboard surfaces of the locking tabs, wherein the distal heads are configured to extend at least partially through the lateral openings and to snap in locking relation behind the locking tabs when the distal heads are pushed past the locking tabs, wherein upon insertion of the latch member into the body, the button detent and the elongated post are disposed in substantial alignment such that upon forced depression of the button, the fingers are configured to urge the distal heads radially inwardly from the locking tabs and the button detent is configured to apply a pushing force against the elongated post to force the latch out of the body.

* * * * *